US009574314B2

(12) United States Patent
Sápi

(10) Patent No.: US 9,574,314 B2
(45) Date of Patent: Feb. 21, 2017

(54) MOBILE FLOOD PROTECTION BARRIER SYSTEM

(71) Applicant: István Péter Sápi, Cegléd (HU)

(72) Inventor: István Péter Sápi, Cegléd (HU)

( * ) Notice: Subject to any disclaimer, the term of this patent is extended or adjusted under 35 U.S.C. 154(b) by 0 days.

(21) Appl. No.: 14/784,193

(22) PCT Filed: Apr. 17, 2013

(86) PCT No.: PCT/IB2013/053048

§ 371 (c)(1),
(2) Date: Oct. 13, 2015

(87) PCT Pub. No.: WO2014/170718

PCT Pub. Date: Oct. 23, 2014

(65) Prior Publication Data

US 2016/0076210 A1 Mar. 17, 2016

(51) Int. Cl.
*E02B 3/10* (2006.01)

(52) U.S. Cl.
CPC ..... *E02B 3/108* (2013.01)

(58) Field of Classification Search
CPC ..... E02B 3/108; E02B 3/106
See application file for complete search history.

(56) References Cited

U.S. PATENT DOCUMENTS 3,213,628 A * 10/1965 Serota ..... E02B 3/108 220/62.21
4,136,995 A * 1/1979 Fish ..... E02B 7/005 210/162
4,692,060 A * 9/1987 Jackson, III ..... E02B 3/108 256/13
4,921,373 A 5/1990 Coffey
5,040,919 A * 8/1991 Hendrix ..... E02B 3/108 405/115
5,125,767 A * 6/1992 Dooleage ..... E02B 3/108 405/114
5,865,564 A * 2/1999 Miller ..... E02B 3/108 405/114

(Continued)

FOREIGN PATENT DOCUMENTS

CA 2267025 A1 * 9/2000 ..... E02B 3/108
DE 10211705 A1 * 10/2003 ..... E02B 3/108

(Continued)

*Primary Examiner* — Frederick L Lagman
(74) *Attorney, Agent, or Firm* — Jason D. Voight

(57) ABSTRACT

A mobile flood protection barrier system for quickly stopping and damming back watercourses, overflows, and for raising the embankment in flood protection as a temporary facility. The system has water-fillable water storage units that are connected to one another and supporting structures, the water storage units are placed into the triangular supporting frames of the supporting structure and fixed to supporting structure, to the spacer bar thereof. The water storage unit is made of a single, continuous, rectangular flexible material, divided into three parts by longitudinal folds, has a triangular prism-shape in the filled-up state, with the surface of the middle folded part in contact with the soil, and is open along its upper edges. The lateral ends of the water storage unit are partially closed. The water storage units can be connected to one another via unit coupling extension portions made from their own material.

7 Claims, 3 Drawing Sheets

(56) References Cited

U.S. PATENT DOCUMENTS

| | | | | | |
|---|---|---|---|---|---|
| 5,971,661 | A * | 10/1999 | Johnson | E02B 3/108 | 405/107 |
| 6,022,172 | A * | 2/2000 | Siyaj | E02B 3/108 | 405/110 |
| 6,164,870 | A * | 12/2000 | Baruh | E02B 3/108 | 405/114 |
| 6,334,736 | B1 * | 1/2002 | Johnson | E02B 3/108 | 405/107 |
| 6,641,329 | B1 * | 11/2003 | Clement | E02B 3/108 | 405/115 |
| 6,679,654 | B1 * | 1/2004 | Wittenberg | E02B 3/108 | 256/13 |
| 7,491,016 | B2 * | 2/2009 | Baruh | E02B 3/108 | 405/114 |
| 7,762,746 | B2 * | 7/2010 | Berenyi | E01F 7/025 | 405/114 |
| 2003/0035690 | A1 | 2/2003 | Earl | | |
| 2006/0275084 | A1 | 12/2006 | Harbeck | | |
| 2012/0195687 | A1 * | 8/2012 | Beard | E02B 3/108 | 405/114 |
| 2014/0290150 | A1 * | 10/2014 | Mouyiaris | E04H 9/145 | 52/2.11 |
| 2015/0275450 | A1 * | 10/2015 | Butler | E02B 3/108 | 405/75 |
| 2015/0354161 | A1 * | 12/2015 | Adams | E02B 3/108 | 405/116 |

FOREIGN PATENT DOCUMENTS

| | | | | |
|---|---|---|---|---|
| EP | 1233109 | A2 * | 8/2002 | B32B 5/26 |
| EP | 1 923 509 | A1 | 5/2008 | |
| GB | 2397606 | A * | 7/2004 | E02B 3/108 |
| GB | 2398331 | A * | 8/2004 | E02B 3/108 |
| WO | WO 9804781 | A1 * | 2/1998 | E02B 3/108 |

* cited by examiner

MOBILE FLOOD PROTECTION BARRIER SYSTEM

This is the national stage of International Application PCT/IB2013/053048, filed Apr. 17, 2013.

The invention relates to a mobile flood protection barrier system for quickly stopping and damming back watercourses, overflows, as well as for raising the embankment in flood protection as a temporary facility, as an emergency barrier, or for protecting real property, mainly on river sections where no protection is in place for the standard flood level.

In practice the best known and most widely used mobile barrier is the sandbag.

The delivery of bags filled with sand to the site, and their removal after the flood has passed is costly, their piling to form a barrier is time- and labour-intensive.

Therefore water-fillable flood-tube barriers are increasingly used as a quick and efficient flood protection solution. The mainly cylindrical tubes made of a flexible material can be connected to traditional fire hoses and used for flood control with pumped water in a short time at sites threatened by flood. By means of special connecting systems the tubes can form barriers of any length, on all terrains, and the tubes can be placed in any direction. One problem with this type of solutions is the connection of the tubes.

A solution is disclosed in patent No. EP 1731678 relating to flood protection comprising a plurality of primarily sand-fillable sacks consisting of flexible fabric material, wherein mutually adjacent coupling sides of adjacent sacks are connected to one another in a coupling region, and at least one stiffening structure is associated with each coupling region.

The stiffening structure extends from the base region of the sacks up to their upper marginal region. The solution is characterized by that mutually adjacent coupling sides of adjacent sacks are connected by means of a force-transmitting connection between the two stiffening structures of the respective coupling sides which are arranged at the inner side in each case. Furthermore each sack is made free of stiffening at those sides which extend perpendicular to the coupling sides.

Patent No. EP 1923509 relates to a connecting element for a protective embankment against flood comprising a first mounting for connecting a first water-fillable, flexible hollow body and a second mounting for connecting a second water-fillable, flexible hollow body. The first mounting and the second mounting are positioned next to each other. The essence of the solution is that a connecting pipe is arranged at an upper side of the first mounting and at an upper side of the second mounting.

The above prior art solutions provide a solution for connecting the tubes to one another, but they do not cover making the tubes safe, to prevent damage to the tubes, puncture, or overfill. Furthermore they do not provide a solution for the risk of floating of the mobile barrier system. When the flood level reaches the top of flood-tube barriers, the weight of the barrier on the soil, thereby its friction capability is reduced, thus the barrier rises, that is it is unable to fulfil its protective role.

The objective of the invention is to eliminate the above deficiencies, and by further developing the known techniques to provide a mobile flood protection barrier system that is easy and quick to set up in a flood protection area, with tube units that are safe and can be connected in a stable and leak-proof manner, have a large friction surface, and can be fixed to the soil, if required.

The set objective is implemented by triangular prism-shaped water storage units that are connected to one another, wherein the water storage units have partially closed ends and are suspended on a supporting structure.

The water storage units have a triangular cross-section in the filled-up state, which is achieved by folding the material of the water storage unit, closing its ends, suspending it on a supporting structure, and placing it into a triangular supporting frame. Thus the water storage unit has a large friction surface, thereby good friction capability.

The invention relates to a mobile flood protection barrier system comprising water-fillable water storage units that are connected to one another and supporting structures, the water storage units are placed into the supporting structures and fixed to the supporting structures. The water storage unit is made of a single, continuous, rectangular flexible material, divided into three parts by longitudinal folds, has a triangular prism-shape in the filled-up state, with the surface of the middle folded part in contact with the soil, and is open along its upper edges.

The lateral ends of the water storage unit are partially closed. At the lateral ends of the water storage unit there are unit coupling extension portions made from its own material. The unit coupling extension portion is formed by the non-closed part of the end of the water storage unit.

The water storage units are connected to one another with the unit coupling extension portions in such a way that the adjacent unit coupling extension portions are slid into each other.

The water storage unit is open at the top and is equipped with supporting straps along its upper edges.

The supporting structure has at least two supporting frames and a spacer bar, they are connected to each other in pairs at their upper parts with the spacer bar in such a way that the spacer bar extends beyond the supporting frames. The water storage unit is fixed into the triangular supporting frames of the supporting structure.

The lateral ends of the water storage unit are partially closed with waterproofing elements. The non-closed part of the water storage unit forms the unit coupling extension portion.

The upper edges of the water storage unit are stiffened, preferably with metal rods.

Any number of water storage units can be placed into an appropriate number of supporting structures.

The connection of the water storage units to one another is solved with the coupling extension portions. Each water storage unit has two unit coupling extension portions.

The water storage units are connected in such a way that one unit coupling extension of the water storage unit protrudes into it, while the other unit coupling extension portion is arranged in the unit coupling extension portion of the adjacent water storage unit protruding into that. The water storage units connected in this way push against each other in the filled-up state and close in a leak-proof manner.

The barrier system can be covered with safety cover, if necessary, with appropriate overlap at the joints. The part of the cover laid on the soil is fixed with ground pegs, or suitable ballast. The supporting structure is fixed to metal bases, if necessary.

The invention is shown in detail in the following figures:

FIG. 1 shows the folding pattern for the water storage unit.

The water storage unit 5, made of a single, continuous, preferably PVC coated industrial fabric, is rectangular in the spread-out state.

Along its two longitudinal edges there are supporting straps 17 made from its own material by folding back and welding. The rectangular fabric is divided into three parts by fold lines in such a way that the sides of the two outer thirds are equal (AB=CD), and the centre line of the middle third coincides with the centre line of the spread-out rectangle.

Figure 2:
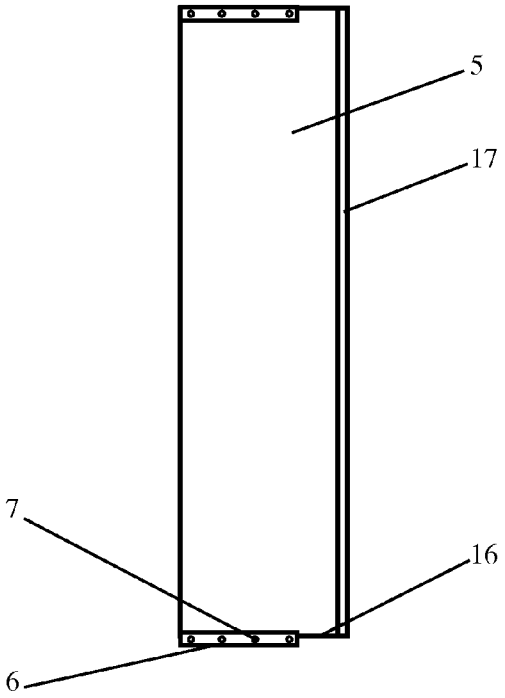
FIG. 2 shows a top view of the water storage unit of the mobile flood protection barrier system in the folded state.

FIG. 2 shows the water storage unit 5 in the folded state.

Figure 1:
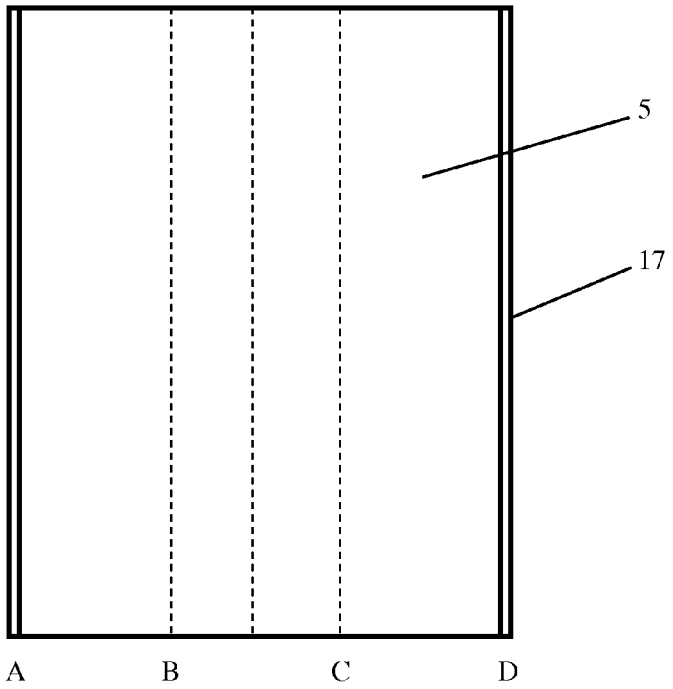
FIG. 1 shows the folding pattern for the water storage unit of the mobile flood protection barrier system.

On the basis of the folding pattern according to FIG. 1, the AB edge of the spread-out water storage unit 5 is folded on the CD edge in such a way that the middle third is folded in between the two outer thirds along its centre line.

The two ends of the folded water storage unit 5 are closed up to $4/5^{th}$ with waterproofing elements 6. The metal waterproofing elements 6 and their through bolts with self-locking nuts 7 ensure leak-proof closing.

The part of the lateral edge of the water storage unit 5 not covered by the waterproofing element 6 is the unit coupling extension portion 16. Each water storage unit 5 has two unit coupling extension portions 16.

Figure 3:
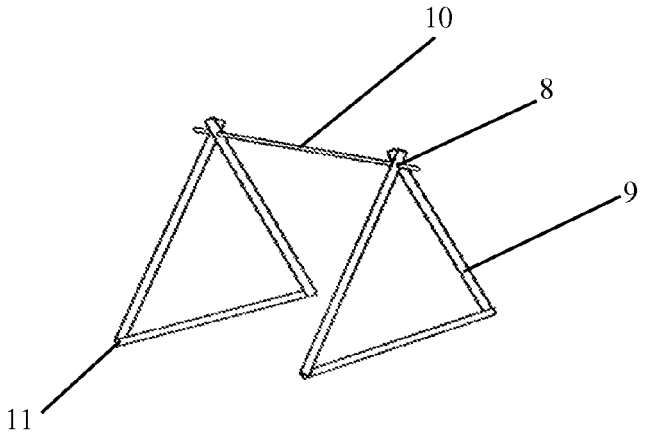
FIG. 3 shows the supporting structure of the mobile flood protection barrier system.

FIG. 3 shows the elements of a supporting structure: two supporting frames 9 connected with a spacer bar 10.

The triangular supporting frame 9 consists of three equal-length hollow sections fixed together with metal screws 11.

The spacer bar 10 is inserted in bores 8 in the upper part of the supporting frames 9, and extends beyond the supporting frames 9. The supporting frames 9 are connected to each other, and kept at an appropriate distance from each other with the spacer bar 10.

Figure 4:
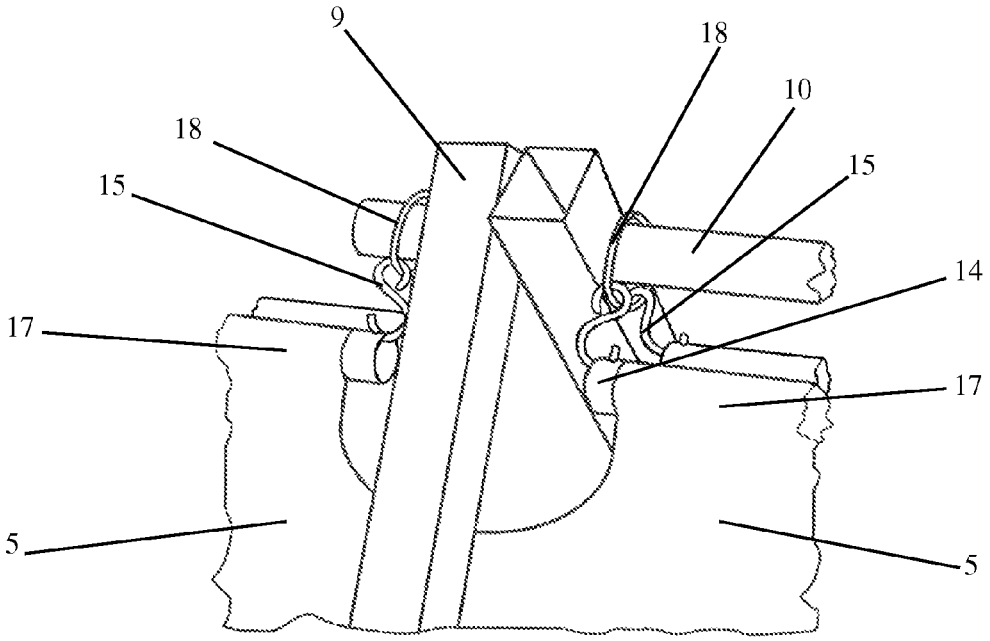
FIG. 4 shows the fixing of the water storage unit of the mobile floor protection barrier system to the supporting structure.

FIG. 4 shows the fixing of the water storage unit 5 to the supporting structure.

Metal rods 14 with bored ends are placed into the supporting straps 17 at the upper edges of the water storage unit 5, and connected to the spacer bar 10 at their bored ends with metal hooks 15. The metal hooks 15 are arranged near the supporting frames 9 and connected to the spacer bar 10 by means of rings 18. The figure shows well that the metal rods 14 are parallel with the spacer bar 10, furthermore that the upper part of the water storage unit 5 stiffened with the metal rods 14 is open.

Figure 5:
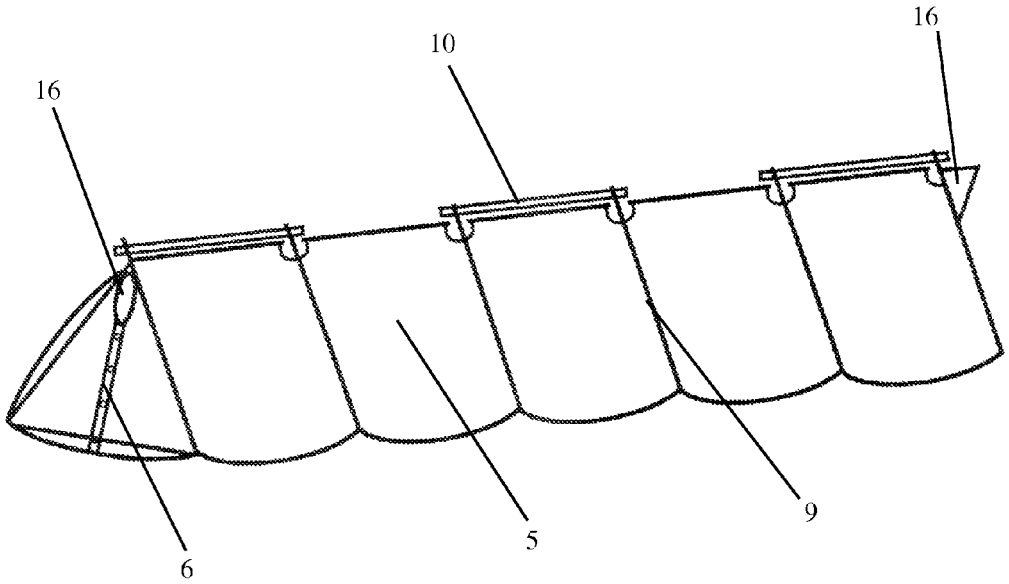
FIG. 5 shows one water storage unit of the mobile flood protection barrier system placed into supporting structures.

FIG. 5 shows a schematic drawing of three supporting structures and a water storage unit 5 filled with water. The three supporting structures support one water storage unit 5. On the left-hand side of the figure the unit coupling extension 16 of the water storage unit 5 protrudes inside the water storage unit 5, while on the right-hand side the unit coupling extension 16 protrudes outwards.

In the solution according to the invention the water storage units 5 are arranged in the supporting structures in such a way that the metal rods 14 in the supporting straps 17 of the water storage units 5 are connected to the spacer bars 10 with metal hooks 15.

One water storage unit 5—depending on its length—is arranged in several supporting structures.

The ends of the water storage unit 5 are partially closed with waterproofing elements 6. The non-closed part of the end of the water storage unit 5 is the unit coupling extension portion 16 ensuring the connection of the water storage units 5 to one another. Each water storage unit 5 has a unit coupling extension portion 16 at both ends. One unit coupling extension portion 16 protrudes into its own water storage unit 5, while the other unit coupling extension portion 16 can be slid into the unit coupling extension portion 16 of the adjacent water storage unit 5, protruding into that. The unit coupling extensions 16 are arranged in each other in the unfilled state.

In the filled-up state, the water storage units 5 arranged in the supporting frames 9 are prism-shaped, open at their upper edges, the lateral ends of the adjacent water storage units 5 push against each other and a leak-proof self-closing connection is formed between the water storage units 5 through the coupling into each other of the unit coupling extension portions 16.

Preparation of the units of the mobile flood protection barrier according to the invention:

The continuous material of a water storage unit 5 is spread out, and the supporting strap 17 is formed in such a way that the material is folded back along its longitudinal edges in the appropriate size and welded on itself with a high frequency welder, then the supporting strap portions 17 are cut to the length of the metal rods 14. The rectangular material equipped with supporting straps 17 is longitudinally folded into three parts in such a way that the centre line of the middle third coincides with the centre line of the spread-out material. The middle third is lifted along its centre line and folded on one of the outer thirds, then the other outer third is also folded on it, and the two ends of the thus folded rectangular material are partially closed in such a way that they are first welded, then closed with waterproofing elements 6. The size of the weld, or the length of the waterproofing element 6 is about $4/5^{th}$ of the lateral edge of the folded water storage unit 5. The part of the water storage unit 5 not closed with the waterproofing element 6 is the unit coupling extension portion 16. The folded water storage unit 5 equipped with waterproofing elements 6 is rolled up.

The parts of the supporting structure, and the metal rods 14 are cut to size in advance.

The mobile flood protection barrier is transported to the flood site in subassemblies. The water storage units 5 equipped with waterproofing elements 6 are in rolls, the supporting frames 9 are screwed together and folded.

The mobile flood protection barrier is assembled at the site of use.

First the supporting structures are erected: the triangular supporting frames 9 are opened and every two supporting frames 9 are connected with a spacer bar 10 inserted in the bores 8 made in the supporting frames 9 in advance.

Any number of supporting structures can be erected next to each other at an appropriate distance along the flood line, as necessary.

The rolled-up water storage unit 5 is placed on the soil in the supporting structure, and rolled out.

The rolled-out water storage unit 5 is at the bottom of the supporting frames 9, distributed evenly.

The metal rods 14 are slid into the supporting straps 17 of the water storage unit 5.

Then the water storage unit 5 is lifted by grabbing the metal rods 14, and fixed to the spacer bar 10 of the supporting structure with metal hooks 15.

In the continuation of the thus assembled about 10-12 meters long and about 120 cm high water storage unit 5 another water storage unit 5 can be rolled out and suspended on supporting structures.

The water storage units 5 are connected to one another in a leak-proof manner in such a way that, in the unfilled state, one unit coupling extension portion 16 is arranged in the unit coupling extension 16 of the adjacent water storage unit 5 protruding into that.

After the barrier is assembled in the desired length, the water storage units 5 are filled with water through their upper open part by means of pumps. First the first water storage unit 5 is filled, then the next one, one after the other.

As a result of the water pressure, the connected unit coupling extension portions 16 arranged in each other push against each other and become self-closing in a leak-proof manner.

After all the water storage units 5 are filled up, the barrier is covered with safety cover, if required. The supporting structures supporting the water storage units 5 are covered longitudinally and diagonally with a water impermeable material to prevent water leakage, with appropriate overlap at the joints, and the part of the cover laid on the soil is protected against underflow with ground pegs, or on concrete or asphalt with suitable ballast, e.g. large steel chains or a row of sandbags.

On lighter soils it is advisable to fix the supporting frames 9 of the supporting structure to the soil.

They can be fixed by pegging the side of the supporting frame 9 in contact with the soil e.g. by means of U-shaped pegs, or in the case of very light soils by using metal bases. Then the supporting frames 9 are fixed to the metal bases.

The height of the mobile flood protection barrier system is determined by the width of the material of the water storage unit 5, the sizing of the supporting structure is a function of the width and length of the material of the water storage unit 5.

The mobile flood protection barrier system according to the invention can be raised, if necessary, by extending the supporting frames 9 and fixing parts to the extended parts in parallel with the spacer bars 10. Then the safety cover is placed on the raised portion.

Another advantage of the invention is that when a water storage unit is overfilled, the excess water simply flows out, without causing any damage to, or the failure of the water storage unit.

A further advantage is that the barrier can be formed in any desired shape, even a closed one, therefore on a flat surface it can be used as a receiving pool for water or other liquids, or bulk materials.

The invention claimed is:

1. A mobile flood protection barrier system comprising water-fillable water storage units (5) that are connected to one another longitudinally and supporting structures, wherein each of the supporting structures has at least two triangular supporting frames (9) and one spacer bar (10) and the supporting frames (9) are connected to each other in pairs at their upper parts with the spacer bar (10), wherein the water storage units (5) are placed into the supporting structures and an upper part of each water storage unit (5) is fixed to the space bar (10) of one or more of the supporting structures, characterized in that each of the water storage units is made of a single, continuous, rectangular flexible material, divided into three parts by longitudinal folds, has a triangular prism-shape in the filled-up state, with the surface of the middle folded part in contact with the soil, and is open along its upper edges, lateral ends of each of the water storage units (5) are partially closed; each of the water storage units (5) is equipped with supporting straps (17) along its upper edges, and at the lateral ends of each of the water storage units (5) there are unit coupling extension portions (16) made from the own material of each of the water storage units (5), and the water storage units (5) are connected to one another longitudinally with the unit coupling extension portions (16) in such a way that adjacent unit coupling extension portions (16) are slid into each other.

2. The mobile flood protection barrier system according to claim 1, characterized in that the supporting frames (9) are connected to each other in pairs at their upper parts with the spacer bar (10) in such a way that the spacer bar (10) extends beyond the supporting frames (9).

3. The mobile flood protection barrier system according to claim 1, characterized in that the lateral ends of each of the water storage units (5) are partially closed with waterproofing elements (6).

4. The mobile flood protection barrier system according to claim 3, characterized in that the waterproofing elements (6) are metal strips.

5. The mobile flood protection barrier system according to claim 1, characterized in that the upper edges of each of the water storage units (5) are stiffened.

6. The mobile flood protection barrier system according to claim 5, characterized in that the upper edges of each of the water storage units (5) are stiffened with metal rods (14) slid into the supporting straps (17).

7. The mobile flood protection barrier system according to claim 4, characterized in that each of the water storage units (5) is fixed to the spacer bar (10) by means of the metal rods (14) equipped with metal hooks (15).

* * * * *